US006428432B1

(12) United States Patent
Kachel

(10) Patent No.: US 6,428,432 B1
(45) Date of Patent: Aug. 6, 2002

(54) LIGHTED BALL TOY

(76) Inventor: Bruce S. Kachel, 2008 Creek Rd., Wildwood, GA (US) 30757

( * ) Notice: Subject to any disclaimer, the term of this patent is extended or adjusted under 35 U.S.C. 154(b) by 0 days.

(21) Appl. No.: 09/510,884

(22) Filed: Feb. 23, 2000

(51) Int. Cl.[7] ..... A63B 43/06
(52) U.S. Cl. ..... 473/570
(58) Field of Search ..... 473/570, 571, 473/603, 604, 605, 606, 609, 610, 611

(56) References Cited

U.S. PATENT DOCUMENTS 5,054,778 A * 10/1991 Maleyko ..... 473/570
5,186,458 A * 2/1993 Redondo ..... 473/570
5,564,702 A * 10/1996 Meffert ..... 473/570
5,639,076 A * 6/1997 Cmiel et al. ..... 473/570
5,762,573 A * 6/1998 Kennedy, III et al. ..... 473/570

* cited by examiner

*Primary Examiner*—Steven Wong
(74) *Attorney, Agent, or Firm*—Alan Ruderman; Stephen J. Stark; Miller & Martin

(57) ABSTRACT

A ball toy has an inner spherical shell within an outer spherical shell, a light source being mounted within the inner shell adjacent to a first end of a plurality of etched optical fibers having the other ends arrayed between the inner and outer shells. The outer shell is translucent while the inner shell has a coated outer surface that reflects light from the optical fibers. Between the light source and the first end of the optical fibers is a color chamber having different color elements through which light may be transmitted and which may move when the ball moves so as to vary the colors received by the optical fibers thereby effecting variation in the color seen as the ball rolls or is otherwise moved, the light seen at the translucent shell fluctuating according to the colors transmitted. A motion switch and/or a master switch may be used to turn the system on and off. A timer may deactivate the circuits if the ball is not moved after a period of time.

19 Claims, 4 Drawing Sheets

LIGHTED BALL TOY

BACKGROUND OF THE INVENTION

This invention relates to a ball toy, and more particularly to one having a plurality of optical fibers disposed in an array adjacent the periphery within a translucent shell, the ball including a light source transmitting light to the fibers preferably through a color chamber which changes the colors transmitted to the optical fibers as the ball is moved.

A number of amusement balls are disclosed in the prior art which illuminate. For example, Bodell U.S. Pat. No. 2,903,820, Maleykl U.S. Pat. Nos. 5,054,778 and 5,228,686, Smiel, et al. U.S. Pat. No. 5,888,156 and Hsieh U.S. Pat. No. 5,779,575 disclose illuminated balls with batteries, LED lights and switches for operation so that illumination may occur upon the occurrence of either rolling or some other type of vibration, or may merely be turned on manually. In none of these, however, do the colors that are transmitted change as the ball moves. Additionally, none of these balls transmit light to the surface of the ball via optical fibers.

In Kachel U.S. Pat. No. 5,029,047, there is disclosed an infant crib mobile which transmits light from a source to a plurality of display objects which revolve, the light being made colorful by means of a slide with color segments disposed so that as the mobile revolves, the color of the light emitted to the optic fibers may change.

In Osborn et al. U.S. Pat. No. 5,277,644, there is disclosed a doll having an ornament at the waist which may be rotated to move a filter from side to side selectively to change the color of light at the ends of optic fibers, a lamp shining through the filter conveying light to the ends of the fibers. The filter has three color portions so that as the ornament is rotated manually, the color of light transmitted to the fiber optic elements varies.

Post U.S. Pat. No. 5,727,577 shows an optical ornament which may be attached to clothing or to the body of a person to convey a fixed array of color light through optic fibers. Smith et al. U.S. Pat. No. 5,387,146 shows a ferris wheel which is used as a crib toy having optical fibers between the circumference of a rotatable disk and a light source, the light filter having sectors of various colors is located between the fibers and the light source.

Accordingly, there are a substantial number of toys or novelty items in the prior art which endeavor to provide an attractive changeable lighting effect. However, none of the known prior art provides an arrangement wherein light may be transmitted from a source to the periphery of a ball by the use of fiber optics and especially to provide color variations as the ball is moved by rotating or the like.

SUMMARY OF THE INVENTION

Consequently, it is a primary object of the present invention to provide a toy ball having fiber optics which may be illuminated to provide an amusement device.

It is another object of the present invention to provide a child's toy in the form of a sphere having an internal light source and optical fibers which receive and transmit light from the source toward the periphery of the sphere to light up the surface.

It is a further object of the present invention to provide a toy in the form of a ball, the interior of the ball having a light source and fiber optics which extend adjacent the source toward the periphery of the ball, and having a color chamber intermediate the light source and the optical fibers through which the light is transmitted so that the surface of the ball is lighted with different colors.

It is a still further object of the present invention to provide a toy in the form of a ball having an outer translucent shell, the ball having a plurality of optical fibers disposed in an array adjacent the interior of the shell surface, the ball including a light source transmitting light to the fibers through a color chamber which changes the colors transmitted to the optical fibers as the ball moves.

Accordingly, the present invention comprises a toy in the form of a ball within which there is a light source and a plurality of optical fibers receiving the light and disposed so that as the ball moves light may be seen on the surface of the ball. Preferably there is a translucent outer shell through which the colors are seen at the surface. Disposed between the light source and on end of the optical fibers is a color chamber which has different color elements which move when the ball moves so as to vary the colors received by the fibers thereby effecting variation in color passing through the fibers and therefore the colors seen on the surface of the translucent shell. Thus, as the ball rolls light seen on the surface of the translucent shell fluctuate in a variable array of colors.

The translucent shell is the outer shell of a two shell spherical ball with the light source, a fiber optic manifold or retention element and the color chamber located within the inner shell, the fibers extending out of the inner shell to the space between the shells.

The shells are each formed as a hemisphere and the inner hemispherical shells each have a bulkhead or wall that extends across the open end or equator of each hemisphere for supporting the various components thereon. The bulkheads are removably connected together and extend beyond the inner shell hemispheres and may be locked between annular ledges on the interior of the outer hemispherical shells. A motion switch and/or master switch switching components to turn the system on and off may be carried by a bulkhead. If there is a master switch it may be controlled by turning one of the hemispherical shells relatively to the other. A timer may deactivate the circuits if the ball is not moved after a given period of time. Moreover, fastener members for connecting one set of hemispheres to the other may be carried by a bulkhead and be accessible from the exterior of the shells to connect the shells together and to separate the shells apart.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
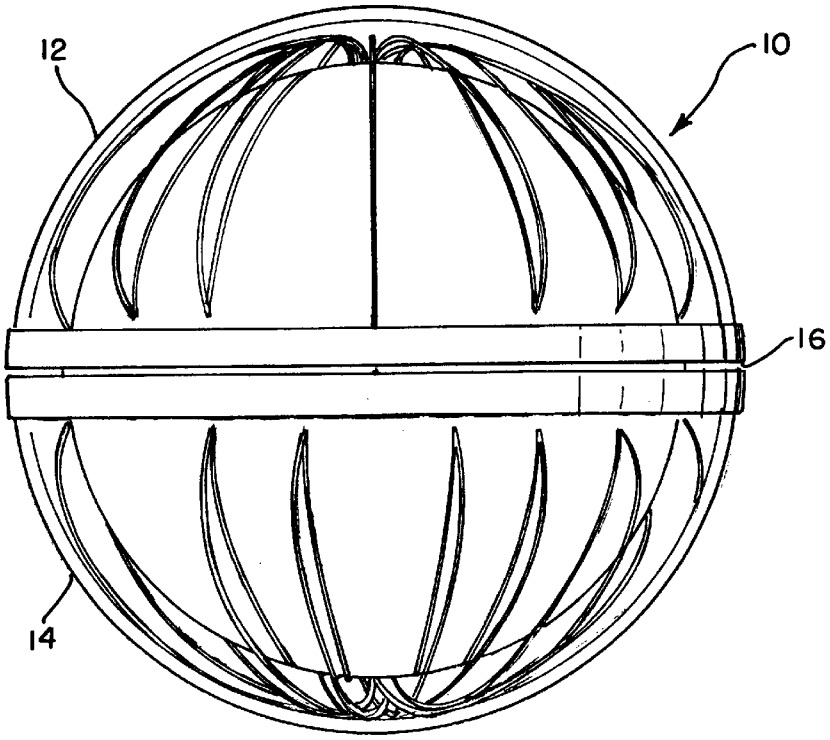
FIG. 1 is an elevational view of the exterior of a ball toy constructed in accordance with the principles of the present invention.

Referring to the drawings, FIG. 1 illustrates the exterior of a toy ball 10 constructed in accordance with the present invention. Although the ball may be made in any convenient configuration such as a prolate spheroid or an oblate, the preferred form of the ball of the present invention is a spheroid or sphere as illustrated. The ball 10 has an outer shell comprising two translucent hemispheres 12, 14 which separate at the major diameter or equator 16 and, as hereinafter made clear, may be rotated relatively to one another to effect turning on all of the circuitry within the ball.

Figure 2:
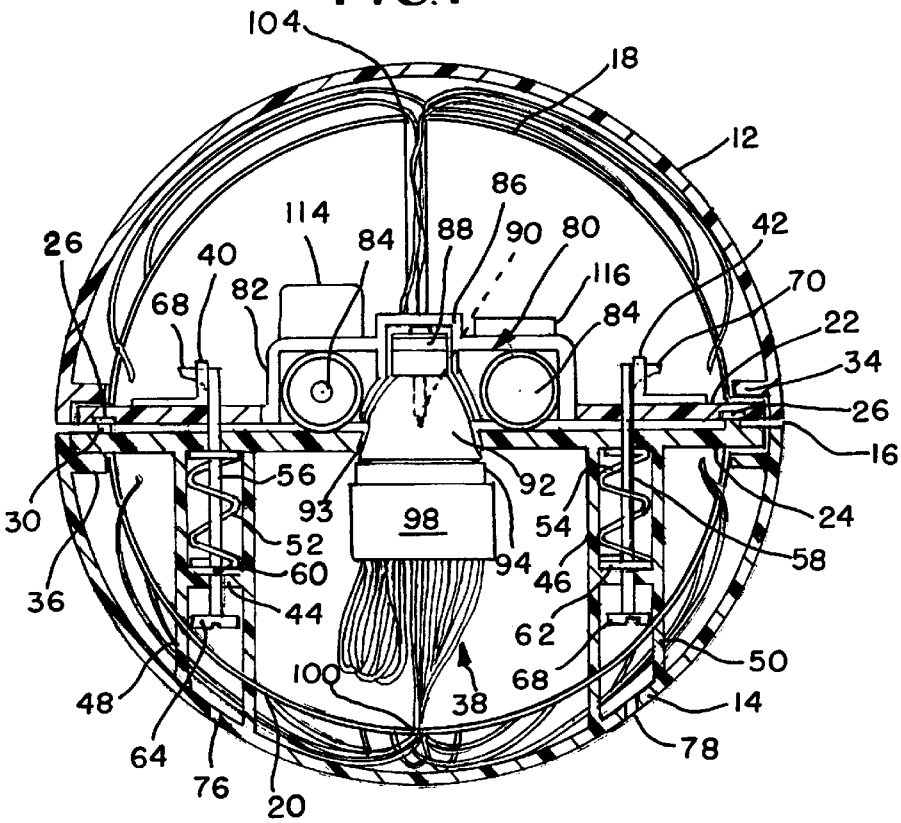
FIG. 2 is a cross sectional view taken through the ball toy illustrated in FIG. 1 with portions of the shells removed for clarity.
Figure 3:
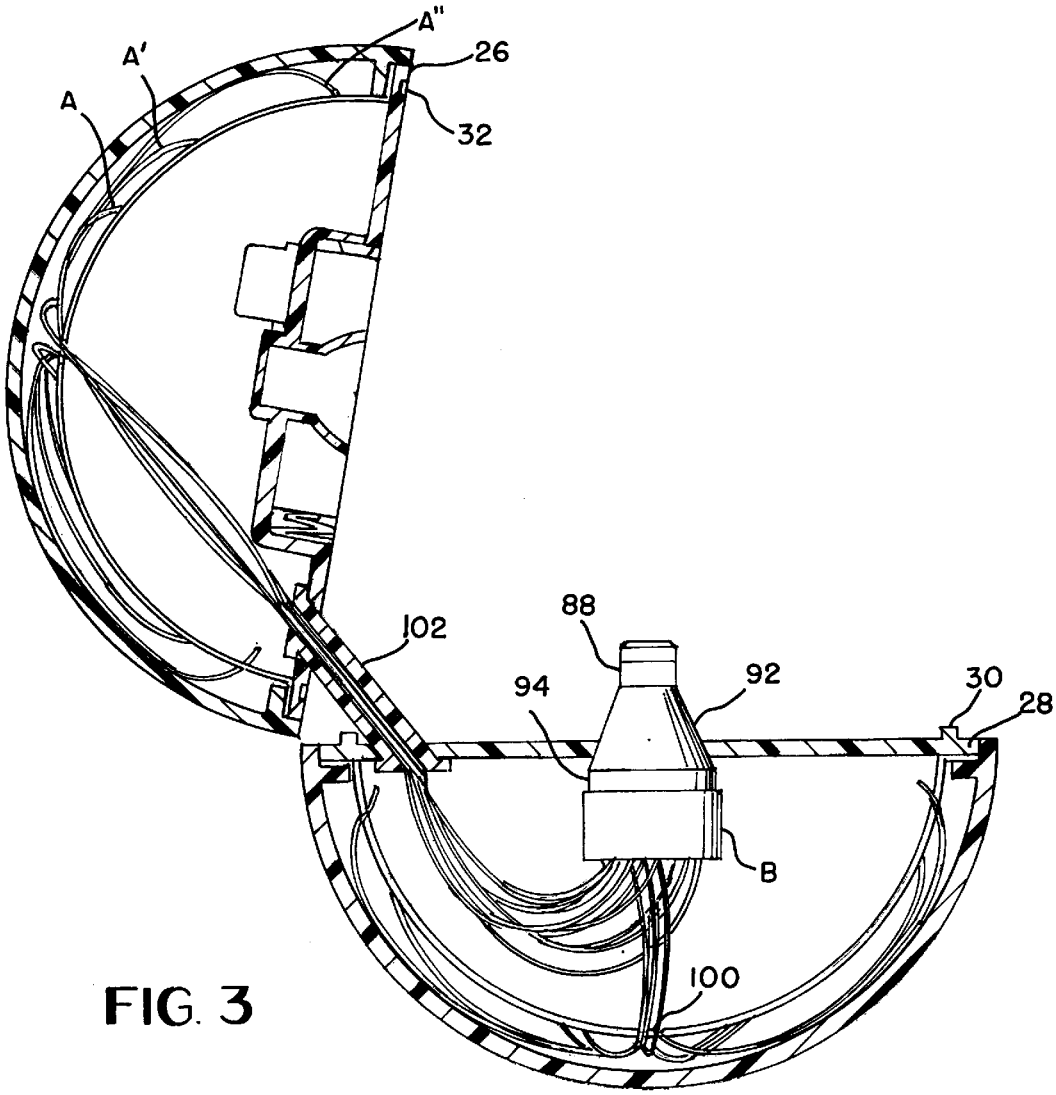
FIG. 3 is a view similar to FIG. 2 but rotated 90° and with the shells separated.

Disposed within the outer shell is an inner shell which also comprises two hemispheres 18, 20, as illustrated in FIGS. 2 and 3. The exterior surface of the inner hemispheres 18, 20 are preferably coated with a chrome plating which reflects light emitted from the optical fibers as hereinafter made clear. Moreover, each of the inner hemispheres 18, 20 has a respective wall bulkhead 22, 24 at the open or diametrical end, i.e., at the equator, the bulkheads each having a larger diameter than the hemispheres 18, 20 and thus project diametrically beyond the surface of the respective hemispheres to define rims 26, 28. One of the bulkheads, e.g. 24 has a ring or annular ridge 30 which is received within a cooperating annular groove 32 in the other of the bulkheads, e.g. 22 as best illustrated in FIG. 3, to align the two inner hemispheres 18, 20 so they may be connected together as hereinafter described. The bulkhead rims 26, 28 are positioned against and bonded to respective annular rims 34, 36 on the interior of the respective outer hemispheres 12, 14 after the optical fibers 38 have been inserted and connected as hereinafter described.

Figure 5:
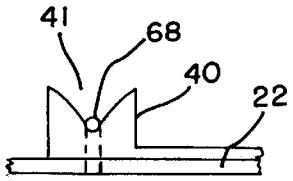
FIG. 5 is a fragmentary elevational view of a portion of one of the inner shells.
Figure 6:
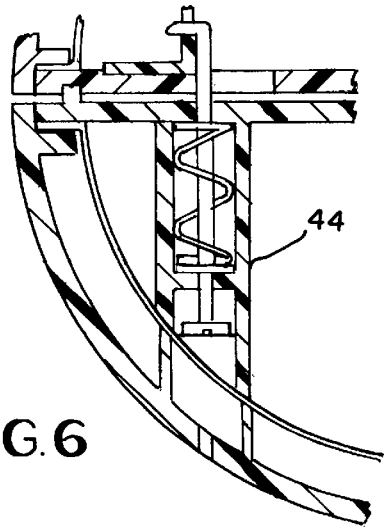
FIG. 6 is a cross sectional view through a portion of the other inner shell.
Figure 4:
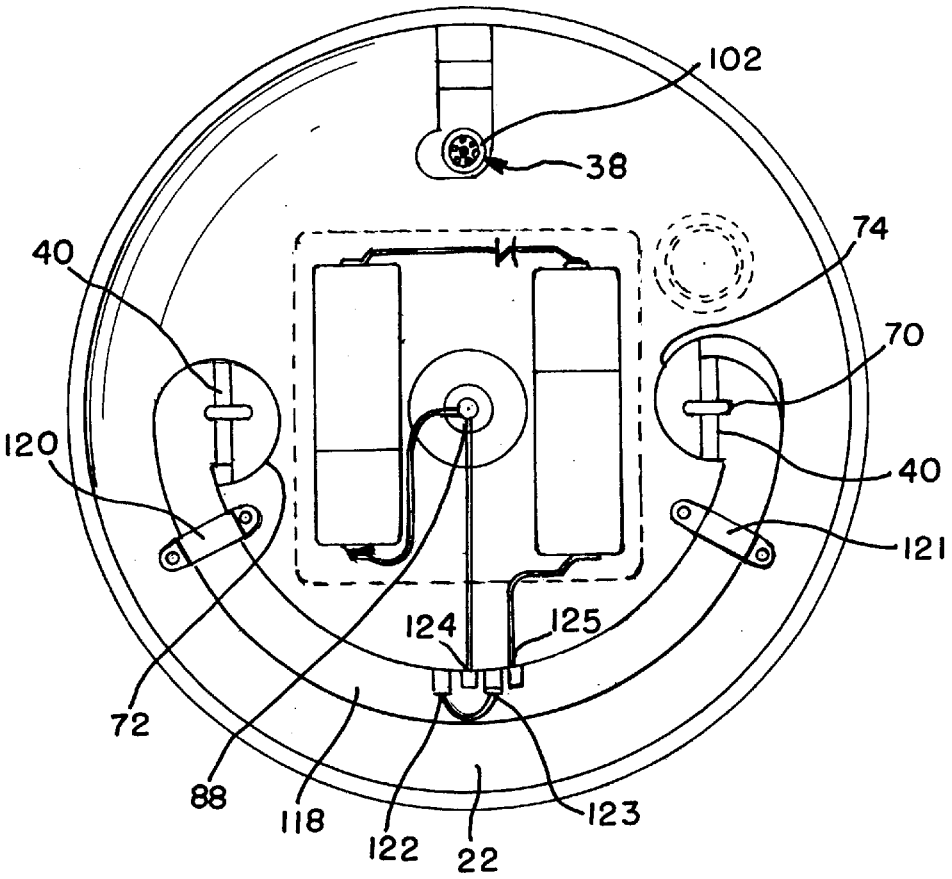
FIG. 4 is a cross sectional view taken substantially along line 4—4 of FIG. 2.

In order to connect the inner hemispheres together and thus the outer hemispheres together, one of the bulkheads, e.g. bulkhead 22 has a pair of spaced apart connecting members 40, 42 which may be formed directly on the bulkhead or as in the preferred embodiment may be formed on a switch member 118 hereinafter described. The members 40, 42 each comprise an upstanding tab having a respective notch 41, only one of which is illustrated in FIG. 5. A pair of small preferably cylindrical wells or housings 44, 46 are formed on the other bulkhead, e.g. bulkhead 24 substantially perpendicular to that bulkhead. Each of the housing 44, 46 have a hollow interior with a smaller slot shaped outlet at one end that opens onto the bulkhead 24 and at the other end opens onto a small open ended cylindrical housing 48, 50 of substantially the same diameter formed on the interior of the outer shell hemisphere 14 so that the housings 48, 50 form an extension of the housings 44, 46. Disposed within each housing 44, 46 is a respective coil spring 52, 54 coiled about a respective fastener rod 56, 58 and abutting the bulkhead 24 at the first end of the housing and abutting a respective ring 60, 62 secured to the respective rod 56, 58.

The rods 56, 58 at the ends adjacent the respective housings 48, 50 have a slotted head 64, 66 for receiving the blade of a screwdriver while the other ends of the rods are formed with smaller respective legs 68, 70 substantially perpendicular to the axis of the rods 56, 58. The legs 68, 70 are received through the slotted opening in the ends of the housings 44, 46 that open onto the bulkhead and are received through similar slotted openings 72, 74 in the bulkhead 22 of the inner hemisphere 18. The legs 68, 70, as illustrated in FIG. 5, may be received within the respective notch 41 of the tab connecting members 40, 42 when the respective rod 56, 58 is pushed upwardly toward the bulkhead 24 against the bias of the respective spring 52, 54 and rotated from a position wherein the legs 68, 70 are not within the respective notch to one wherein the respective leg overlays the respective notch and may be received within the notch when the force overcoming the spring bias is released. The inward and rotational force is applied by a screwdriver blade received within openings 76, 78 in the surface of the outer hemispherical shell 14 which opens into the interior of the housings 48, 50.

Secured to the bulkhead 22 of the inner shell hemisphere 18 is a housing 80 which forms a compartment 82 in which a source of energy such as batteries 84 are disposed and also forms a compartment 86 which receives the base 88 of the lamp 90, and a substantially conical or similar shaped reflector 92 within which the lamp is disposed. The lamp base 88, lamp 90 and reflector 92 form a sub-assembly similar to that in a conventional flashlight which is attached to the bulkhead 24 of the inner hemisphere 20, the exterior of the reflector 92 being received through and secured within an opening 93 in the bulkhead, as best illustrated in FIG. 3.

A color changer 94, hereinafter described, may be mounted intermediate a peripheral rim 96 of the reflector 92 and an optical fiber retaining ring 98. The retaining ring 98 mounts one end of a plurality of the optical fibers 38. Substantially half of the fibers 38 pass through one or more bores such as a small bore 100 in the hemisphere 20 while the remaining fibers extend through an elastomeric conduit 102 secured within receiving apertures in both the bulkheads 22, 24 and are routed through one or more bores such as a small bore 104 in the hemisphere 18. As illustrated in FIG. 3, the hemispheres may be separated with the conduit 102 remaining attached to both bulkheads. When the hemispheres are connected together the conduit slides within the receiving apertures in the bulkheads and in the operative position are partly within the interior of each of the inner hemispheres.

The optical fibers 38 are etched along the lengths thereof so that light may be emitted therefrom, in addition to light which conventionally is emitted from the ends, and the ends routed through the bores 100 and 104 are disposed intermediate the inner shells and outer shells as illustrated in FIGS. 2 and 3, the fibers passing through the bore 100 being routed substantially radially to between the shells 14 and 20 while those passing through the bore 104 are routed radially between the shells 12 and 18. Thus, there is a substantially equal number of optical fibers between the two sets of shell pairs and disposed at substantially equally spaced apart longitudes relative to the equator 16.

Figure 7:
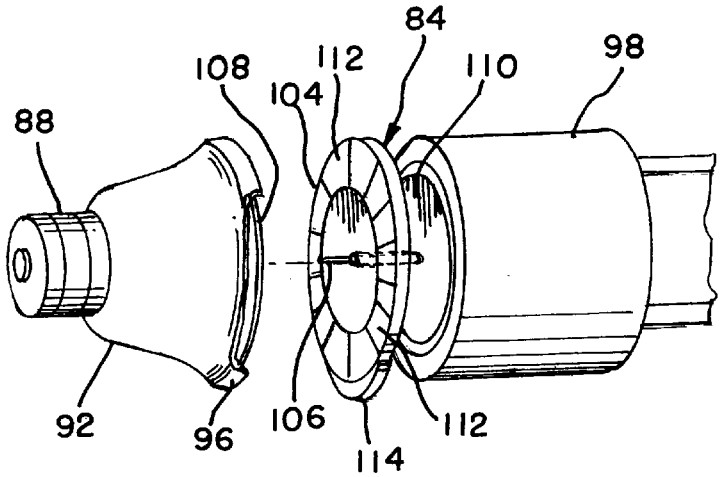
FIG. 7 is a disassembled perspective view illustrating one form of the color chamber intermediate the light source and the fiber optic manifold.

In one form of the color changer 94 according to the present invention, i.e., the preferred form, as illustrated in FIG. 7, the color changer comprises a transparent disk 104 having an axle 106 journalled in a pair of fixed spaced apart disks 108, 110 respectively carried in the rim 96 of the reflector 92 and the fiber retaining ring 98. The disk carries a plurality of transparent color segments 112 spaced circumferentially about the disk. A small weight 114 is disposed at a location on the edge of the disk, and as the ball 10 is moved, the disk oscillates together with the axle 106 about the axis of the axle. Alternatively the axle may be fixed to the disks 108, 110 with the color disk 104 journalled on the axle. In either case as the disk oscillates the light from the lamp seen by any particular optical fiber varies with the motion of the ball.

Figure 8:
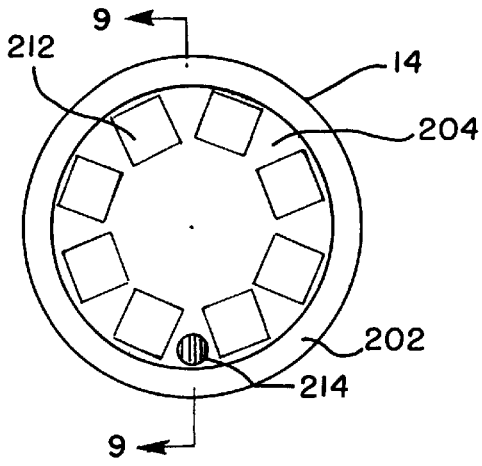
FIG. 8 is an elevational view of a modification of the color chamber illustrated in FIG. 7.
Figure 9:
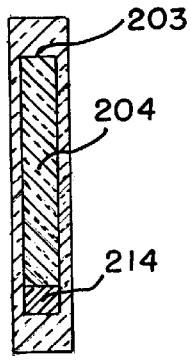
FIG. 9 is a cross sectional view taken substantially along line 9—9 of FIG. 8.
Figure 10:
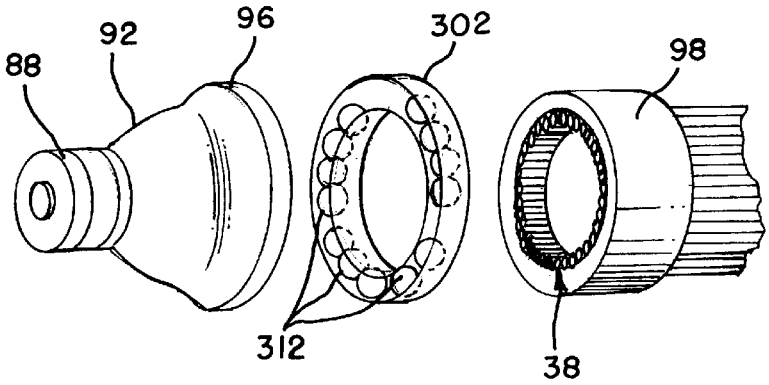
FIG. 10 is a view similar to FIG. 7 but illustrating another color chamber constructed in the course of the present invention.

A modification of the color changer is illustrated in FIG. 8. Here the changer comprises an annular housing 202 having an annular recess 203 within which is positioned a disk 204. The disk 204 is slightly thinner than the depth of the recess and the spacing between the recess walls so that the disk is journally mounted within the recess and may move relatively to the housing 202. The disk may have a plurality of cut-outs spaced apart circumferentially about the face of the disk and there are different transparent color inserts 212 disposed within a respective cut-out at a radius which is substantially at the disposition of the optical fibers 38 in the retainer ring 98. These inserts may merely be transparent color plastic members such as color transparent paper. Thus, light may pass from the lamp 90 through the color inserts and be transmitted to the fibers. The colors transmitted may be varied by use of a small weight 214 in the form of a slug disposed on the disk 204 spaced radially from the center thereof so that movement of the toy ball 10 causes the disk to oscillate as the weight 214 moves and tends to move with the force of gravity. Thus, the light seen by any particular optical fiber changes with movement of the ball.

In another preferred form of the color chamber there is provided an annular housing 302 similar to the housing 202 and having a similar recess. However, in this embodiment rather than a disk carrying spaced colors at fixed intervals, here there are a plurality of transparent color balls 312 entrapped within the recess at the radius of the optical fibers in the retainer ring 98 in a manner similar to the balls within a bearing race of a ball bearing. Thus, as the toy ball moves, the balls move or revolve within the recess and the colors seen by a particular optical fiber varies accordingly.

In order to energize the ball to transmit energy from the batteries 84 to the lamp, the present invention may include a conventional motion switch 114 which closes the circuit when the ball moves. In this case, there may also be a timer 116 having a conventional timing circuit chip which would deactivate or open the circuit if the ball is not moved after a period of time, such as two minutes, so as to preserve the batteries. Moreover, either alternatively to or in addition to the motion switch 114, there may be a master switch to activate or deactivate the circuitry to turn on or turn off the lamp 90. To this end the master switch 118 may be an arcuate shaped member disposed on the bulkhead 24 and secured thereto by brackets 120, 121. The switch 118 may carry two contacts 122, 123, while there are two similar contacts 124, 125 on the bulkhead 22 superposed above the contacts 122, 124. The contacts 122, 123 are bridged or connected together and the contacts 124, 125 are connected into a circuit with the base 88 of the lamp 90 and with the batteries 84. The spacing between the contact pairs 122, 123 is equal to the spacing between the contact pairs 124, 125. Thus since the contacts 122, 123 are mounted on the bulkhead 24 of the lower hemispherical set of shells, and the contacts 124, 125 are mounted on the upper bulkhead 22, rotation of one hemispherical set relative to the other hemispherical set in one direction a small amount, e.g., three degrees may align and engage the contacts 122, 124 and the contacts 123, 125 to close the circuitry and light the lamp. Relative rotation of the hemispheres in the opposite direction will then open the circuit and shut the transmission of light.

When the circuitry is energized and light is transmitted through the color chamber to the elongated fiber optical elements the light in the various elements varies as the ball is moved so that a visual display is seen on the surface of the outer spherical shell. The chrome coating on the inner spherical shell aids in reflecting the light outwardly. The etched optical fibers permit light to be seen through the entire lengths of the fibers intermediate the inner and outer spheres.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed therein is:

1. A ball toy having a plurality of elongated light transmitting members each having a pair of ends, a light source optically coupled to one end of said members, the other end of said members being disposed in a selective array, and a color chamber disposed intermediate said light source and said one end of said members, said color chamber having a plurality of color elements, said ball including a shell having at least a partially translucent surface, whereby light may be communicated along said members and transmitted through said surface when said light source is activated.

2. A ball toy as recited in claim 1, wherein said members comprise fiber optic elements.

3. A ball toy as recited in claim 1, wherein said color elements move relatively to said one end when said ball is moved, thereby to vary the color optically coupled to each member.

4. A ball toy comprising, a first shell and a second shell disposed within said first shell, a plurality of elongated light transmitting members each having a first end disposed within said second shell and a second end disposed intermediate said first and second shells, said first shell comprising at least a partially translucent surface, a light source optically coupled to one end of said members, the other end of said members being disposed in a selective array, and a color chamber disposed intermediate said light source and said one end of said members, said color chamber having a plurality of color elements, whereby light may be communicated along said members and transmitted through said surface in an array when said light source is activated.

5. A ball toy as recited in claim 4, wherein said first and second shells comprise spheroids.

6. A ball toy as recited in claim 5, wherein said second shell has a light reflective surface.

7. A ball toy as recited in claim 4, wherein said members comprise fiber optic elements.

8. A ball toy as recited in claim 4, wherein said color elements move relatively to said one end when said ball is moved, thereby to vary the color optically coupled to each member.

9. A ball toy as recited in claim 8, wherein said color chamber includes a disk mounted for revolving about an axis, and said color elements comprise transparent color sections of said disk.

10. A ball toy as recited in claim 8, wherein said color chamber includes a housing and said color elements include transparent color balls moveable relatively to said housing about an axis through said housing.

11. A ball toy as recited in claim 8, wherein said second shell has a light reflective surface.

12. A ball toy as recited in claim 4, wherein said second shell comprises a pair of hemispheres, said hemispheres each having a bulkhead at the major diameter closing the respective hemisphere, one of said bulkheads carrying connecting elements which cooperate with corresponding connecting elements carried by the other of said bulkheads for fastening the hemispheres of the second shell together selectively.

13. A ball toy as recited in claim 12, wherein each second shell is secured to a respective hemisphere of said first shell, and said hemispheres of said first shells are fastened together when the hemispheres of the second shells are fastened together.

14. A ball toy as recited in claim 12, wherein said light source is carried by one of said bulkheads.

15. A ball toy as recited in claim 4, wherein said one end of said light transmitting members are mounted within an annular retaining ring and disposed in a circumference about said ring.

16. A ball toy as recited in claim 15, color elements are located within the annular retaining ring, and said color elements move relatively to said one end when said ball is moved, thereby to vary the color optically coupled to each member.

17. A ball toy as recited in claim 16, wherein said color chamber includes a disk mounted for revolving about an axis, and said color elements comprise transparent color sections of said disk.

18. A ball toy as recited in claim 16, wherein said color chamber includes a housing and said color elements include transparent color balls moveable relatively to said housing about an axis through said housing.

19. A ball toy as recited in claim 16, wherein said second shell has a light reflective surface.

* * * * *